US011633323B2

(12) United States Patent
Furutani

(10) Patent No.: US 11,633,323 B2
(45) Date of Patent: Apr. 25, 2023

(54) CHAIR-TYPE MASSAGE MACHINE

(71) Applicant: Fuji Medical instruments Mfg. Co., Ltd., Osaka (JP)

(72) Inventor: Takeshi Furutani, Osaka (JP)

(73) Assignee: Fuji Medical Instruments Mfg. Co., Ltd., Osaka (JP)

( * ) Notice: Subject to any disclaimer, the term of this patent is extended or adjusted under 35 U.S.C. 154(b) by 585 days.

(21) Appl. No.: 16/678,262

(22) Filed: Nov. 8, 2019

(65) Prior Publication Data

US 2020/0170877 A1 Jun. 4, 2020

(30) Foreign Application Priority Data

Nov. 29, 2018 (JP) ..... JP2018-223931

(51) Int. Cl.
*A61H 7/00* (2006.01)
*A61H 23/00* (2006.01)

(52) U.S. Cl.
CPC ..... *A61H 7/007* (2013.01); *A61H 23/006* (2013.01); *A61H 2201/1671* (2013.01); *A61H 2203/0431* (2013.01); *A61H 2203/0437* (2013.01); *A61H 2205/06* (2013.01)

(58) Field of Classification Search
CPC .. A61H 2205/06; A61H 7/007; A61H 23/006; A61H 2201/1671; A61H 2203/0437; A61H 15/0078; A61H 2201/0149; A61H 1/00; A61H 2001/0233; A61H 23/00; A61H 2023/002; A61H 9/00; A61H 2009/0014; A61H 7/00; A47C 1/03; A47C 3/12; A47C 7/54; A47C 7/546; A47C 20/023; B60N 2/976
See application file for complete search history.

(56) References Cited

U.S. PATENT DOCUMENTS 5,931,536 A * 8/1999 Wu ..... A47C 1/0308 248/404
7,832,804 B2 * 11/2010 LaFreniere ..... A47C 1/143 297/31
2008/0048475 A1 * 2/2008 Tanizawa ..... A61H 23/04 297/284.6
2010/0312155 A1 * 12/2010 Fukuyama ..... A61H 9/0078 601/98

(Continued)

FOREIGN PATENT DOCUMENTS

JP 2003-310683 A 11/2003
JP 2008-188055 A 8/2008

(Continued)

OTHER PUBLICATIONS

Machine translation of WO2014203407A1 claims and description. 2014.*

(Continued)

*Primary Examiner* — Philip R Wiest
*Assistant Examiner* — Tyler A Raubenstraw
(74) *Attorney, Agent, or Firm* — Masuvalley & Partners; Peter Martinez

(57) ABSTRACT

A chair-type massage machine includes a base member, a slide member slidable with respect to the base member in a first direction and in the direction opposite to it, and an arm treatment portion rotatably fitted to the slide member at an end part of it in the first direction.

15 Claims, 5 Drawing Sheets

(56) References Cited

U.S. PATENT DOCUMENTS

| | | | | |
|---|---|---|---|---|
| 2016/0316917 | A1* | 11/2016 | Qi | A47C 1/0308 |
| 2020/0086778 | A1* | 3/2020 | Jeon | H04W 4/40 |

FOREIGN PATENT DOCUMENTS

| | | | | | |
|---|---|---|---|---|---|
| JP | 2017104715 | A | * | 6/2017 | |
| WO | WO-2005120425 | A1 | * | 12/2005 | A61H 9/0078 |
| WO | WO-2014203407 | A1 | * | 12/2014 | A61H 9/0078 |

OTHER PUBLICATIONS

Machine translation of WO2005120425A1 claims and description. 2005.*

Machine translation of JP201704715A claims and description. 2017.*

JPO, Japanese Office Action (with English translation) dated Sep. 1, 2022 in the priority Japanese patent application No. 2018-223931, 9pages.

* cited by examiner

CHAIR-TYPE MASSAGE MACHINE

RELATED APPLICATIONS

This nonprovisional application claims priority under 35 U.S.C. § 119(a) to Patent Application No. 2018-223931 filed in Japan on Nov. 29, 2018, the entire contents of which are hereby incorporated by reference.

BACKGROUND OF THE INVENTION

Field of the Invention

The present invention relates to a chair-type massage machine provided with an arm treatment portion.

Description of Related Art

Recent years have seen development of different types of chair-type massage machines provided with an arm treatment portion.

If the position of the arm treatment portion is fixed, the massaged part in the forearms of a treated person varies due to the difference in the length of the forearms among treated persons and the change in the reclining angle of the backrest portion. In the worst case, a massage cannot be applied to a body part near the fingertips or the elbow.

To provide a solution to the above problem, Japanese Patent Application published as No. 2003-310683 proposes a massage machine in which an arm treatment portion slides on a guide rail provided at a side of a seat portion.

However, in the massage machine proposed in Japanese Patent Application published as No. 2003-310683, the moving range of the arm treatment portion is limited, and the arm treatment portion cannot move to an appropriate position according to the physical build or the posture of a treated person.

SUMMARY OF THE INVENTION

The present invention is aimed at providing a chair-type massage machine in which an arm treatment portion can move to an appropriate position according to the physical build or the posture of a treated person.

According to one aspect of what is disclosed herein, a chair-type massage machine includes a base member, a slide member slidable with respect to the base member in a first direction and in the opposite direction to it, and an arm treatment portion rotatably fitted to the slide member at an end part of it in the first direction.

The significance and effects of the present invention will be further clarified by the description of embodiments below. It should be understood that the following embodiments are merely examples of how the present invention can be implemented, and thus the senses of the terms used to describe the present invention and its constituent elements are not limited in any way to those in which they are used in the following description of embodiments.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF THE PREFERRED EMBODIMENTS

Hereinafter, illustrative embodiments of the present invention will be described in detail with reference to the accompanying drawings.

1. Embodiment

Figure 1:
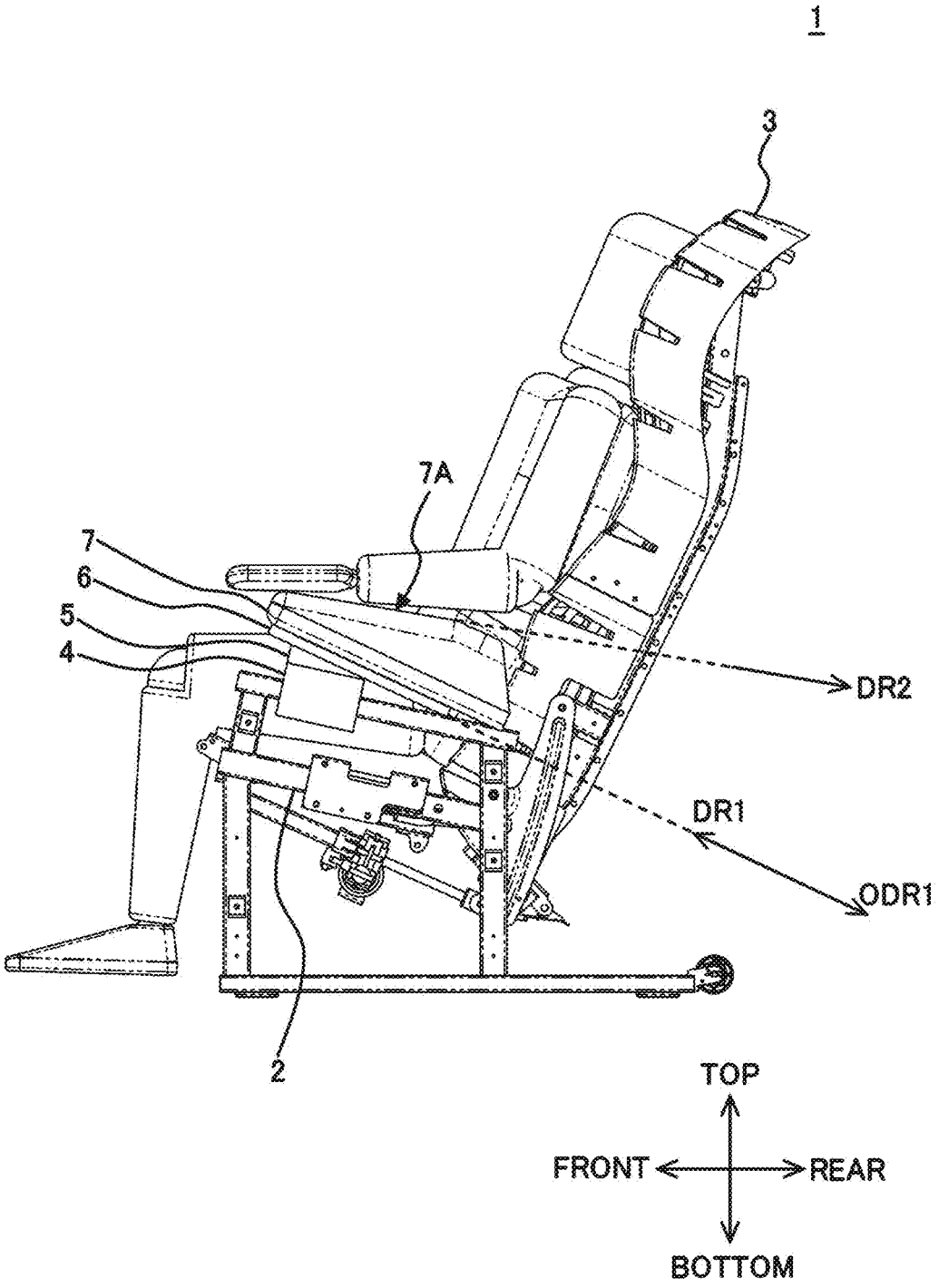
FIG. 1 is a side view of a chair-type massage machine according to one embodiment.
Figure 2:
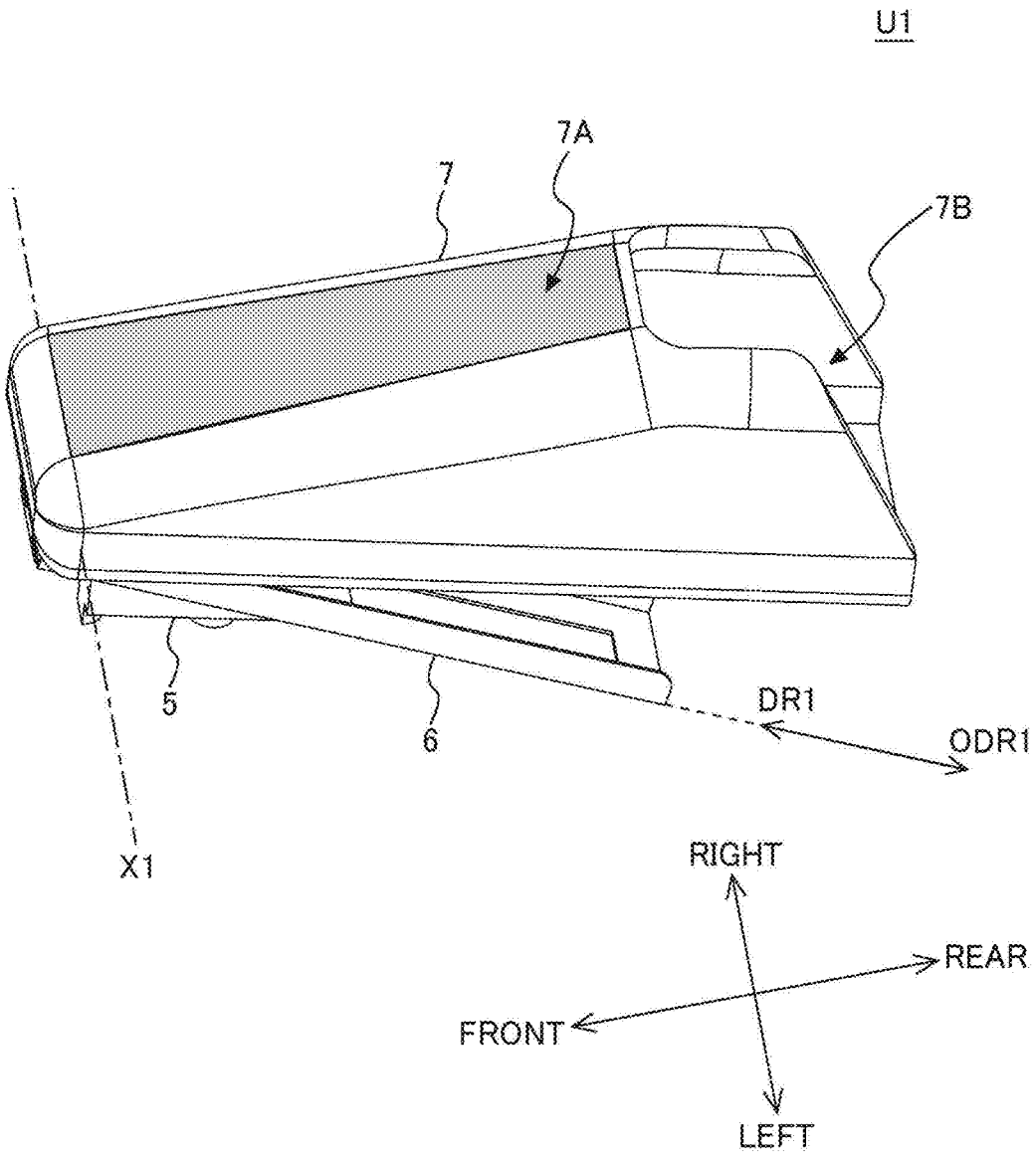
FIG. 2 is a perspective view of an arm unit.
Figure 3:
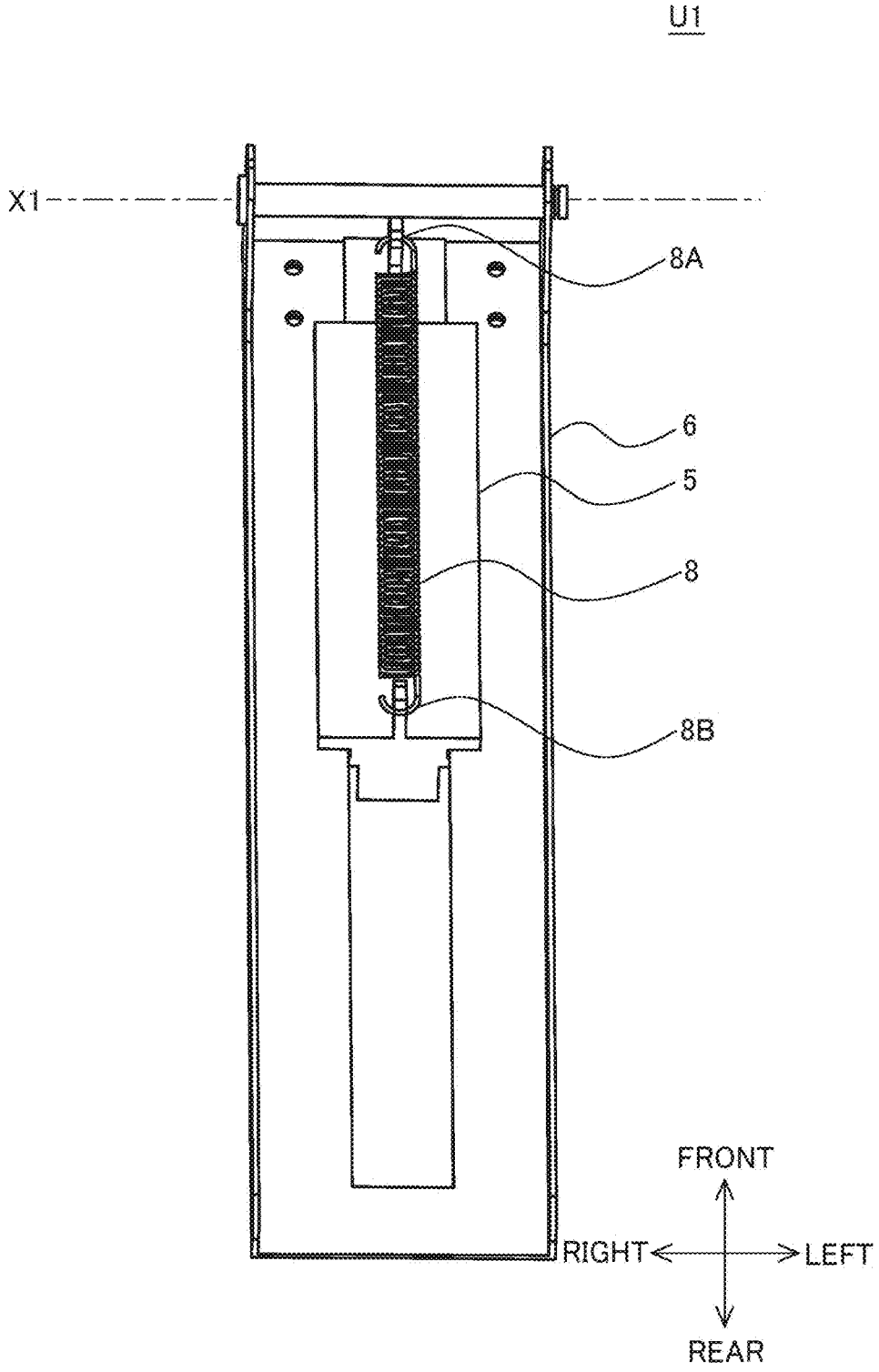
FIG. 3 is a bottom view of the arm unit.

FIG. 1 is a side view of a chair-type massage machine 1 (hereinafter, referred to as "massage machine 1") according to one embodiment. FIG. 2 is a perspective view of an arm unit U1 provided in the massage machine 1. FIG. 3 is a bottom view of the arm unit U1 provided on the massage machine 1. In FIGS. 1 to 3, and also in FIGS. 4 to 5 referred to later, only parts constituting the framework of the massage machine 1 are illustrated.

In the following descriptions, "front side" refers to the front side (front-face side) as viewed from a treated person sitting in the massage machine 1 with its backrest portion 3 not collapsed, and "rear side" refers to the rear side (rear-face side) as viewed from the treated person sitting in the massage machine 1 with the backrest portion 3 not collapsed. "Upper side" refers to the upper side (head side) as viewed from the treated person sitting in the massage machine 1 with the backrest portion 3 not collapsed, and "lower side" refers to the lower side (leg side) as viewed from the treated person sitting in the massage machine 1 with the backrest portion 3 not collapsed. "Right side" refers to the right side as viewed from the treated person sitting in the massage machine 1 with the backrest portion 3 not collapsed, and "left side" refers to the left side as viewed from the treated person sitting in the massage machine 1 with the backrest portion 3 not collapsed.

The massage machine 1 includes a seat portion 2, the backrest portion 3, a supporting member 4, a base member 5, a slide member 6, an arm treatment portion 7, and a coil spring 8. The arm unit U1 provided on the massage machine 1 includes the base member 5, the slide member 6, the arm treatment portion 7, and the coil spring 8.

The massage machine 1 includes two supporting members 4, two base members 5, two slide members 6, two arm treatment portions 7, and two coil springs 8. The supporting member 4, the base member 5, the slide member 6, the arm treatment portion 7, and the coil spring 8 on one side are for the right arm, and the supporting member 4, the base member 5, the slide member 6, the arm treatment portion 7, and the coil spring 8 on another side are for the left arm.

The seat portion 2 supports the buttocks and the thighs of the treated person.

The backrest portion 3 supports the shoulders, the hips, and the back of the treated person. The backrest portion 3 is fitted to the rear end of the seat portion 2 to be rotatable about a reclining rotary shaft extending along the left-right direction. The backrest portion 3 is provided with a massage unit (unillustrated) having massaging members. The massage unit is guided by guide rails (unillustrated) provided in the backrest portion 3 to ascend and descend in the longitudinal direction of the backrest portion 3. Here, the guide rails may be extended to a rear portion of the seat portion 2 to allow the massage unit to ascend and descend in the longitudinal direction of the seat portion 2 and the backrest portion 3. The massage unit includes the massaging members, a kneading drive mechanism which makes the massaging members perform a kneading motion, and a tapping drive mechanism which makes the massaging members perform a tapping motion.

The supporting member 4 is fixed to a frame located over a side face of the seat portion 2. The base member 5 is fixed to the supporting member 4 to be supported by it.

The slide member 6 is slidable in a first direction DR1 and in an opposite direction ODR1 to the first direction with respect to the base member 5.

The arm treatment portion 7 is rotatably fitted to an end part of the slide member 6 in the first direction DR1 and is rotatable about a rotation axis X1 (see FIG. 2) extending in the left-right direction.

The arm treatment portion 7 has a top face 7A (see the shaded part in FIG. 2). The top face 7A of the arm treatment portion 7 has a substantially flat surface. The top face 7A of the arm treatment portion 7 can be used as an armrest when the arm treatment portion 7 and the slide member 6 are closed.

As shown in FIG. 1, when the arm treatment portion 7 and the slide member 6 are closed, the top face 7A of the arm treatment portion 7 is substantially parallel to a second direction DR2. The second direction DR2 is a direction tilted from the horizontal direction, that is, a direction pointing downward away from the pivot (the rotation axis X1) of the arm treatment portion 7 in the longitudinal direction of the arm treatment portion 7.

The seat portion 2 is often shaped to be increasingly low rearward. When the seat portion 2 so shaped is used, if the top face 7A of the arm treatment portion 7 is substantially parallel to the second direction DR2 when the arm treatment portion 7 and the slide member 6 are closed, the treated person can place the elbow on the top face 7A of the arm treatment portion 7 in comfortable posture.

Unlike in this embodiment, the top face 7A of the arm treatment portion 7 may be substantially parallel to the horizontal direction when the arm treatment portion 7 and the slide member 6 are closed.

As shown in FIG. 2, an opening 7B is provided in a rear part of the arm treatment portion 7. Through the opening 7B of the arm treatment portion 7, the treated person can put the forearm and the hand into the arm treatment portion 7. Inside the arm treatment portion 7, an air bag (unillustrated) is provided. With the inflation and deflation of the air bag (unillustrated), a massage is applied to the forearm and the hand of the treated person. Unlike in this embodiment, any massaging mechanism other than an air bag may be provided inside the arm treatment portion 7.

As shown in FIG. 3, the coil spring 8 is provided beneath the base member 5 and the slide member 6. One end 8A of the coil spring 8 is fitted to the front end of the slide member 6. The other end 8B of the coil spring 8 is fitted to the rear end of the base member 5. Thus, when the slide member 6 slides with respect to the base member 5 in the first direction DR1, the coil spring 8 expands to bias (pulls) the slide member 6 in the opposite direction ODR1. Unlike in this embodiment, any biasing portion (such as a rubber member) other than the coil spring 8 maybe used.

In the massage machine 1, the position of the arm treatment portion 7 can be adjusted with the amount of sliding of the slide member 6 with respect to the base member 5 and the amount of rotation of the arm treatment portion 7 with respect to the slide member 6 (the angle formed between the slide member 6 and the arm treatment portion 7). This makes it possible for the arm treatment portion 7 to move to an appropriate position according to the physical build or the posture of the treated person.

Figure 4:
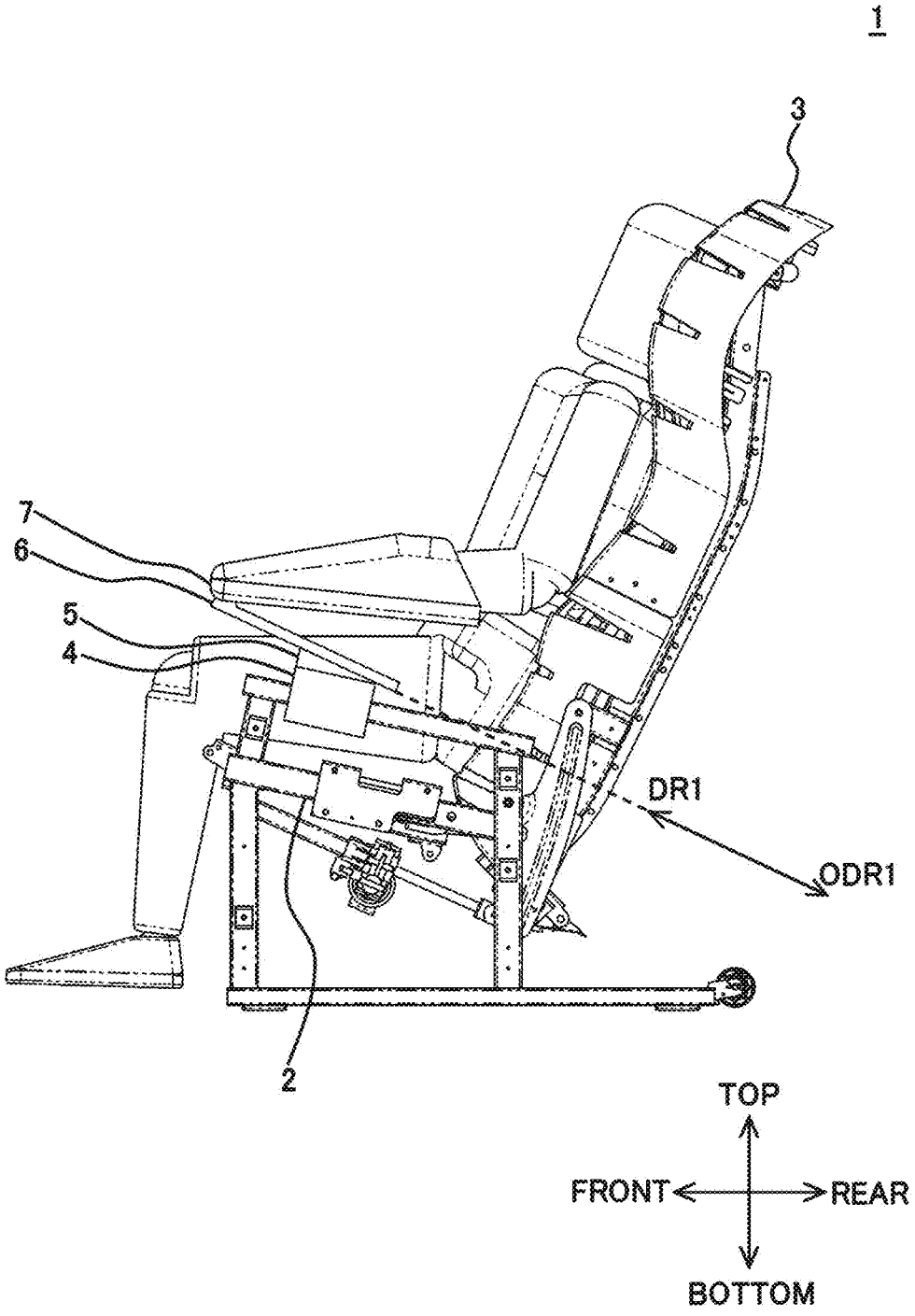
FIG. 4 is a side view of the chair-type massage machine according to one embodiment.

When the backrest portion 3 is not collapsed as shown in FIG. 4, the slide member 6 and the arm treatment portion 7 are pushed forward by the forearm and the hand of the treated person, and this causes the coil spring 8 to bias (pull) the slide member 6 in the opposite direction ODR1. The slide member 6, the arm treatment portion 7, and the forearm and the hand of the treated person stop at a position where the pushing force of the forearm and the hand balances with the biasing force of the coil spring 8.

Figure 5:
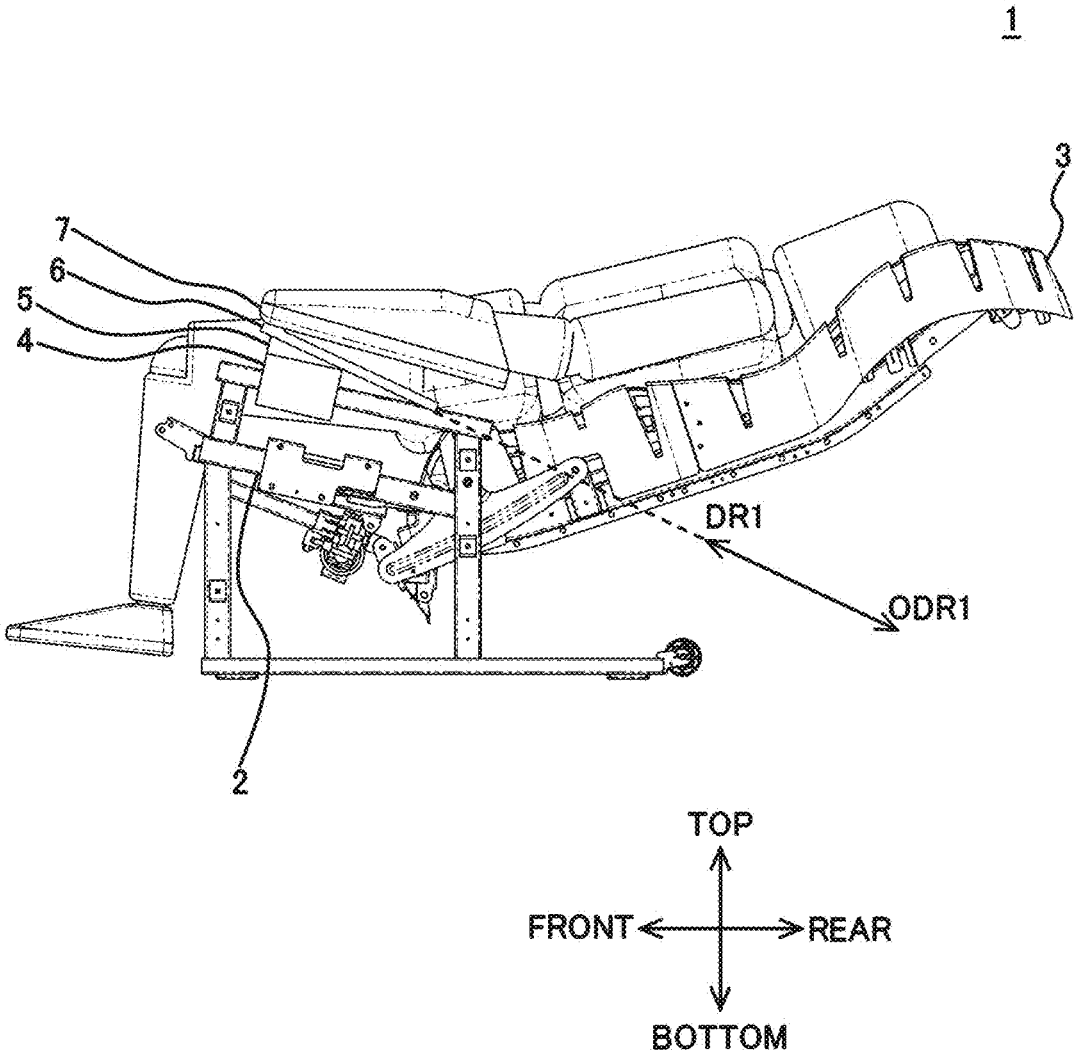
FIG. 5 is a side view of the chair-type massage machine according to one embodiment.

As the state of the backrest portion 3 changes from a non-collapsed state as shown in FIG. 4 to a collapsed state as shown in FIG. 5, the forearm and the hand of the treated person recede gradually. As the state of the backrest portion 3 changes from the non-collapsed state shown in FIG. 4 to the collapsed state shown in FIG. 5, the biasing force of the coil spring 8 assists the receding of the slide member 6 and the arm treatment portion 7. Thus, as the state of the backrest portion 3 changes from the non-collapsed state shown in FIG. 4 to the collapsed state shown in FIG. 5, the slide member 6 and the arm treatment portion 7 recede smoothly following the receding forearm and the hand of the treated person.

2. Others

It should be understood that the embodiments described above are in every aspect illustrative and not restrictive, and that the technical scope of the present invention is defined not by the above description of the embodiments but by the appended claims and encompasses any modifications within a sense and scope equivalent to those of the claims.

For example, the biasing portion which biases the slide member 6 in the opposite direction ODR1 does not necessarily have to be provided. In this case, it is preferable that the slide member 6 and the arm treatment portion 7 be movable by their own weight up to the rear-most position in the sliding range of the slide member 6 by adjusting the sliding direction of the slide member 6, the position of the center of gravity of the slide member 6, the position of the center of gravity of the arm treatment portion 7, and the like.

For example, the supporting member 4 may be, instead of being fixed to the frame located over the side face of the seat portion 2, fitted to the frame located over the side face of the seat portion 2 so as to be movable along the longitudinal direction of the frame. This increases the movable range of the arm treatment portion 7, and thus diversify the physical build and the posture of the treated person which arm treatment portion 7 can cope with. For example, a rotation direction biasing portion which biases the arm treatment portion 7 in a direction in which the arm treatment portion 7 rotates may be provided. In this case, the rotation direction biasing portion may bias the arm treatment portion 7 in the direction in which the slide member 6 and the arm treatment portion 7 open (separate from each other). Or, on the contrary, the arm treatment portion 7 may be biased in the direction in which the slide member 6 and the arm treatment portion 7 close.

Biasing the arm treatment portion 7 in the direction in which the slide member 6 and the arm treatment portion 7 separate from each other can assist the treated person in lifting up a body part around the elbow. On the other hand, biasing the arm treatment portion 7 in the direction in which the slide member 6 and the arm treatment portion 7 close can assist the treated person in lowering a body part around the elbow. Either biasing in the direction in which the slide member 6 and the arm treatment portion 7 separate from each other or biasing in the direction in which the slide member 6 and the arm treatment portion 7 close may be adopted based on the criterion of which is more comfortable for the treated person with consideration given to, for example, the effects of the sliding direction of the slide member 6, the position of the center of gravity of the slide member 6, the position of the center of gravity of the arm treatment portion 7, and the like.

Here, when biasing in the direction in which the slide member 6 and the arm treatment portion 7 separate from each other is adopted, for making the massage machine 1 compact when not in use, it is preferable to provide a lock mechanism by which the arm treatment portion 7 can be fixed to the slide member 6 when the slide member 6 and the arm treatment portion 7 are closed.

For example, the top face 7A of the arm treatment portion 7 may be given, instead of a substantially flat surface, a curved surface which is concave downward. When the top face 7A of the arm treatment portion 7 is not used as an armrest, the top face 7A of the arm treatment portion 7 may have a curved surface which is convex upward, or the top face 7A does not need to be provided on the arm treatment portion 7. If the top face 7A of the arm treatment portion 7 is not provided, when the forearm and the hand of the treated person is lifted, the forearm and the hand of the treated person may be prevented from falling off the arm treatment portion 7 by a means other than the top face 7A of the arm treatment portion 7.

3. Overview

The chair-type massage machine described above includes a base member, a slide member slidable with respect to the base member in the first direction and in the opposite direction to it, and an arm treatment portion rotatably fitted to the slide member at an end part of it in the first direction (a first structure).

The chair-type massage machine of the first structure described above may further include a first biasing portion which biases the slide member in the opposite direction to the first direction (a second structure).

The chair-type massage machine of the first or second structure described above may further include a second biasing portion which biases the arm treatment portion in the direction in which the arm treatment portion rotates (a third structure).

In the chair-type massage machine of any of the first to the third structures described above, the arm treatment portion may have a top face (a fourth structure).

What is claimed is:

1. A chair-type massage machine comprising:

a base member;

a slide member which is slidable in a first direction and in an opposite direction thereto with respect to the base member; and an arm treatment portion which is fitted to an end portion of the slide member in the first direction so as to be rotatable about a rotation axis, wherein the rotation axis is arranged at the end portion of the slide member in the first direction so as to extend in a direction perpendicular to the first direction, and the arm treatment portion rotates between a closed state where the arm treatment portion overlaps the slide member and a state where an end portion of the arm treatment portion in the opposite direction is away upward from the slide member.

2. The massage machine according to claim 1, further comprising:

a first biasing portion which biases the slide member in the opposite direction to the first direction.

3. The massage machine according to claim 1, further comprising:

a second biasing portion which biases the arm treatment portion in a direction in which the arm treatment portion rotates about the rotation axis.

4. The massage machine according to claim 2, further comprising:

a second biasing portion which biases the arm treatment portion in a direction in which the arm treatment portion rotates about the rotation axis.

5. The massage machine according to claim 1, wherein the arm treatment portion permits a forearm of a treated person to be put therein through an opening with a top face thereof closed, the opening being provided in the end portion of the arm treatment portion in the opposite direction, and in a state where the arm treatment portion is closed, the top face is horizontal or the top face inclines lower from a horizontal direction as the top face goes from the first direction toward the opposite direction.

6. The massage machine according to claim 2, wherein the arm treatment portion permits a forearm of a treated person to be put therein through an opening with a top face thereof closed, the opening being provided in the end portion of the arm treatment portion in the opposite direction, and in a state where the arm treatment portion is closed, the top face is horizontal or the top face inclines lower from a horizontal direction as the top face goes from the first direction toward the opposite direction.

7. The massage machine according to claim 3, wherein the arm treatment portion permits a forearm of a treated person to be put therein through an opening with a top face thereof closed, the opening being provided in the end portion of the arm treatment portion in the opposite direction, and in a state where the arm treatment portion is closed, the top face is horizontal or the top face inclines lower from a horizontal direction as the top face goes from the first direction toward the opposite direction.

8. The massage machine according to claim 4, wherein the arm treatment portion permits a forearm of a treated person to be put therein through an opening with a top face thereof closed, the opening being provided in the end portion of the arm treatment portion in the opposite direction, and in a state where the arm treatment portion is closed, the top face is horizontal or the top face inclines lower from a horizontal direction as the top face goes from the first direction toward the opposite direction.

9. The massage machine according to claim 2, wherein one end of the first biasing portion is fitted to the end portion of the slide member in the first direction, and another end of the first biasing portion is fitted to an end portion of the base member in the opposite direction.

10. The massage machine according to claim 1, further comprising a locking mechanism which, in a state where the slide member and the arm treatment portion are closed, allows the arm treatment portion to be fixed to the slide member.

11. The massage machine according to claim 6, wherein an end portion of the arm treatment portion in the first direction is closed.

12. The massage machine according to claim 7, wherein an end portion of the arm treatment portion in the first direction is closed.

13. The massage machine according to claim 8, wherein an end portion of the arm treatment portion in the first direction is closed.

14. The massage machine according to claim 9, wherein an end portion of the arm treatment portion in the first direction is closed.

15. The massage machine according to claim 1, wherein a position of the arm treatment portion is adjusted with an amount of sliding of the slide member with respect to the base member and an amount of rotation of the arm treatment portion with respect to the slide member.

* * * * *